US008058955B2

(12) United States Patent
Ko

(10) Patent No.: US 8,058,955 B2
(45) Date of Patent: Nov. 15, 2011

(54) WATERPROOF WAVEGUIDE ASSEMBLY HAVING A CORE ASSEMBLY WITH A SEAM ENCLOSED BY A METALLIC ENCLOSURE

(75) Inventor: Tung Yi Ko, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 221 days.

(21) Appl. No.: 12/418,838

(22) Filed: Apr. 6, 2009

(65) Prior Publication Data

US 2010/0061690 A1 Mar. 11, 2010

(30) Foreign Application Priority Data

Sep. 11, 2008 (TW) ..... 97216404 U

(51) Int. Cl.
*H01P 3/12* (2006.01)

(52) U.S. Cl. ..... 333/248; 333/254

(58) Field of Classification Search ..... 333/239, 333/241, 242, 248, 254
See application file for complete search history.

(56) References Cited

U.S. PATENT DOCUMENTS

| | | | | |
|---|---|---|---|---|
| 2,436,421 | A * | 2/1948 | Cork | 138/125 |
| 2,479,288 | A * | 8/1949 | Allen | 138/139 |
| 2,783,440 | A * | 2/1957 | Lovick, Jr. | 333/239 |
| 3,648,201 | A * | 3/1972 | Gissel | 333/241 |
| 3,692,063 | A * | 9/1972 | Wagele | 138/139 |
| 5,398,010 | A * | 3/1995 | Klebe | 333/239 |
| 2007/0171007 | A1 * | 7/2007 | Mahlandt et al. | 333/239 |

* cited by examiner

*Primary Examiner* — Benny Lee
(74) *Attorney, Agent, or Firm* — WPAT, P.C.; Anthony King

(57) ABSTRACT

A waterproof communication apparatus comprises a core assembly having at least one seam, configured to transmit an electromagnetic wave; and a seamless enclosure enclosing the core assembly, configured to prevent the ingress of atmospheric moisture through the at least one seam into the inside of the core assembly. In one embodiment, the core assembly and the enclosure are made of metallic materials, and a metallurgical bond is formed between the core assembly and the enclosure.

8 Claims, 6 Drawing Sheets

WATERPROOF WAVEGUIDE ASSEMBLY HAVING A CORE ASSEMBLY WITH A SEAM ENCLOSED BY A METALLIC ENCLOSURE

BACKGROUND OF THE INVENTION

1. Field of the Invention

The present invention relates to a waterproof structure for a communication apparatus, and more particularly, to a communication apparatus having waterproof capability by a seamless enclosure.

2. Description of the Related Art

Outdoor communication apparatuses are affected by different weather conditions, and the most influential of these is wet weather. Therefore, one of the critical design considerations of outdoor communication apparatuses is waterproofing.

Generally, outdoor communication apparatuses are assembled together with several portions, and the seams between the portions, exposed to the outside environment, are passageways that allow the penetration of environmental moisture into the interior of the communication apparatus. Consequently, the success of the waterproofing treatment for communication apparatuses depends on the seam sealing means adopted to prevent the penetration of moisture.

FIG. 1 shows a prior art waterproof structure for a communication device 100. The communication device 100 comprises an upper component 102 and a lower component 104, between which a seam 106 is formed. The seam is sealed with an O-ring 108, which is deformed by fastening the upper component 102 and the lower component 104 using screws 110 and thereby achieves waterproofing capability. However, the O-ring 108, which is in solid form, cannot fill all the cavities on the rough surfaces therebetween. Therefore, the use of an O-ring 108 for waterproofing cannot completely prevent moisture penetration. Moreover, O-rings 108 may degrade over time, and such degradation is a potential cause of waterproofing failure.

FIG. 2 shows another prior art waterproof structure for a communication device 100. In this prior art example, the seam 106 formed between the upper component 102 and the lower component 104 is sealed using an adhesive 202 and is fastened using screws 110 for preventing moisture penetration. Although an adhesive 202 can fill in any irregularities between the two joined surfaces, the adhesive 202 will deteriorate when exposed to weather and UV radiation over time. Such environmental factors weaken its waterproofing capability such that using an adhesive 202 is not a complete solution.

In summary, to date there is no complete solution for protecting outdoor communication apparatuses from the penetration of outside moisture. Under the influences of environmental factors such as drastic long-term climate changes and UV radiation, proper seam sealing is difficult. Therefore, there is still a need for a waterproofing means that can completely prevent outdoor communication apparatuses from the penetration of outside moisture.

SUMMARY OF THE INVENTION

The present invention proposes a waterproof communication apparatus for outdoor use. The communication device is seamlessly enclosed to prevent atmospheric moisture from entering the inside of the communication device, and thereby achieves waterproof capability.

The present invention proposes a waterproof communication apparatus according to a first embodiment. The waterproof communication apparatus comprises a core assembly having at least one seam, configured to transmit an electromagnetic wave; and an enclosure enclosing the core assembly, configured to prevent the penetration of atmospheric moisture through the at least one seam into the inside of the core assembly.

The present invention proposes a waterproof communication apparatus according to a second embodiment. The waterproof communication apparatus comprises a core assembly having at least one seam and an enclosure enclosing the core assembly, configured to prevent atmospheric moisture from reaching the wave-guide structure through the at least one seam. An inner peripheral surface of the core assembly includes a wave-guide structure varied in height.

The present invention proposes a waterproof communication apparatus according to a third embodiment. The waterproof communication apparatus comprises a wave-guide device having at least one seam and an enclosure enclosing the wave-guide device, provided by a casting process, configured to prevent the penetration of atmospheric moisture through the at least one seam into the inside of the wave-guide device.

BRIEF DESCRIPTION OF THE DRAWINGS

The invention will be described according to the appended drawings in which.

DETAILED DESCRIPTION OF THE INVENTION

Figure 1:
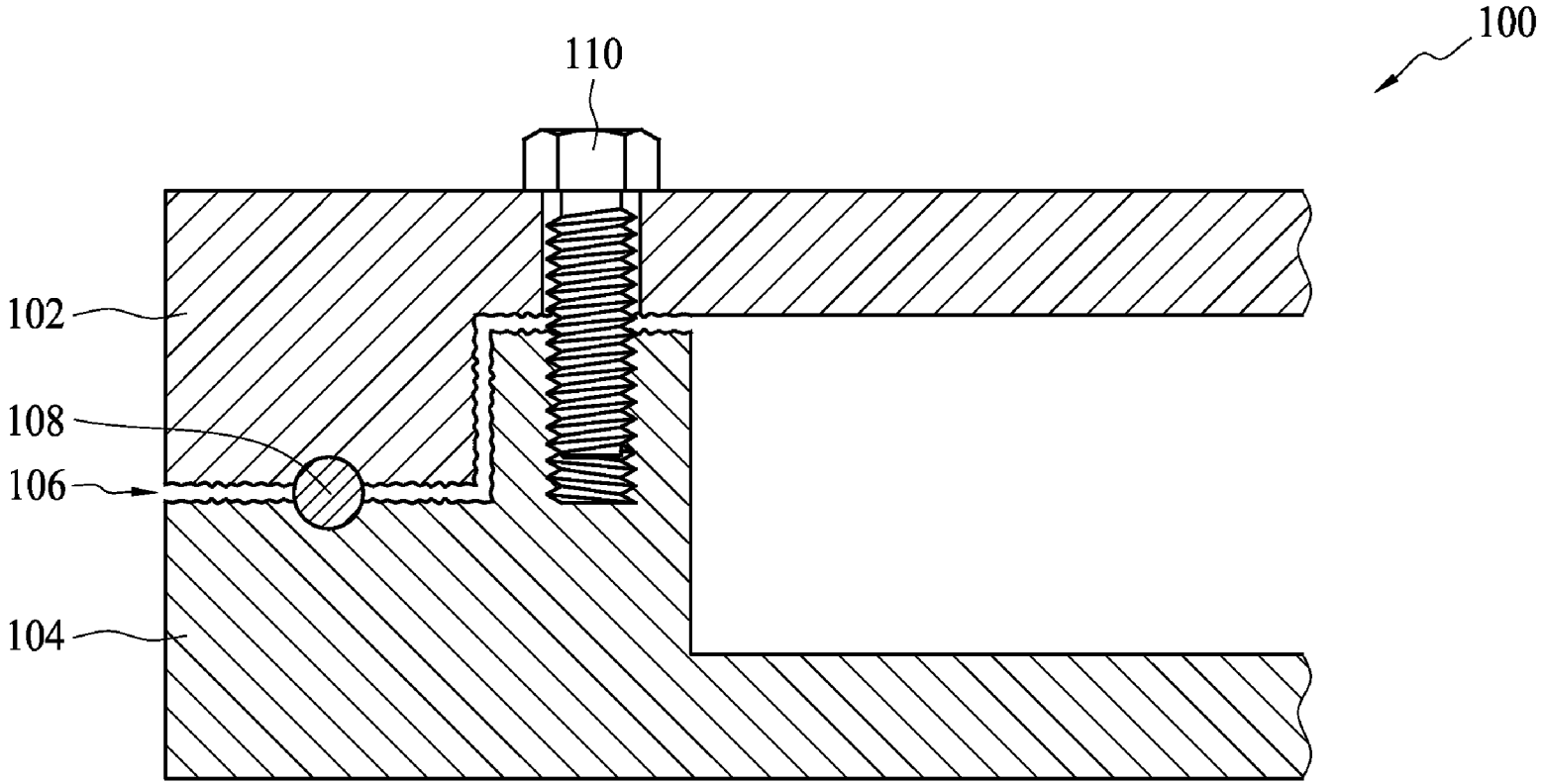
FIG. 1 (Prior Art)
FIG. 1 shows a prior art waterproof structure for a communication device.
Figure 2:
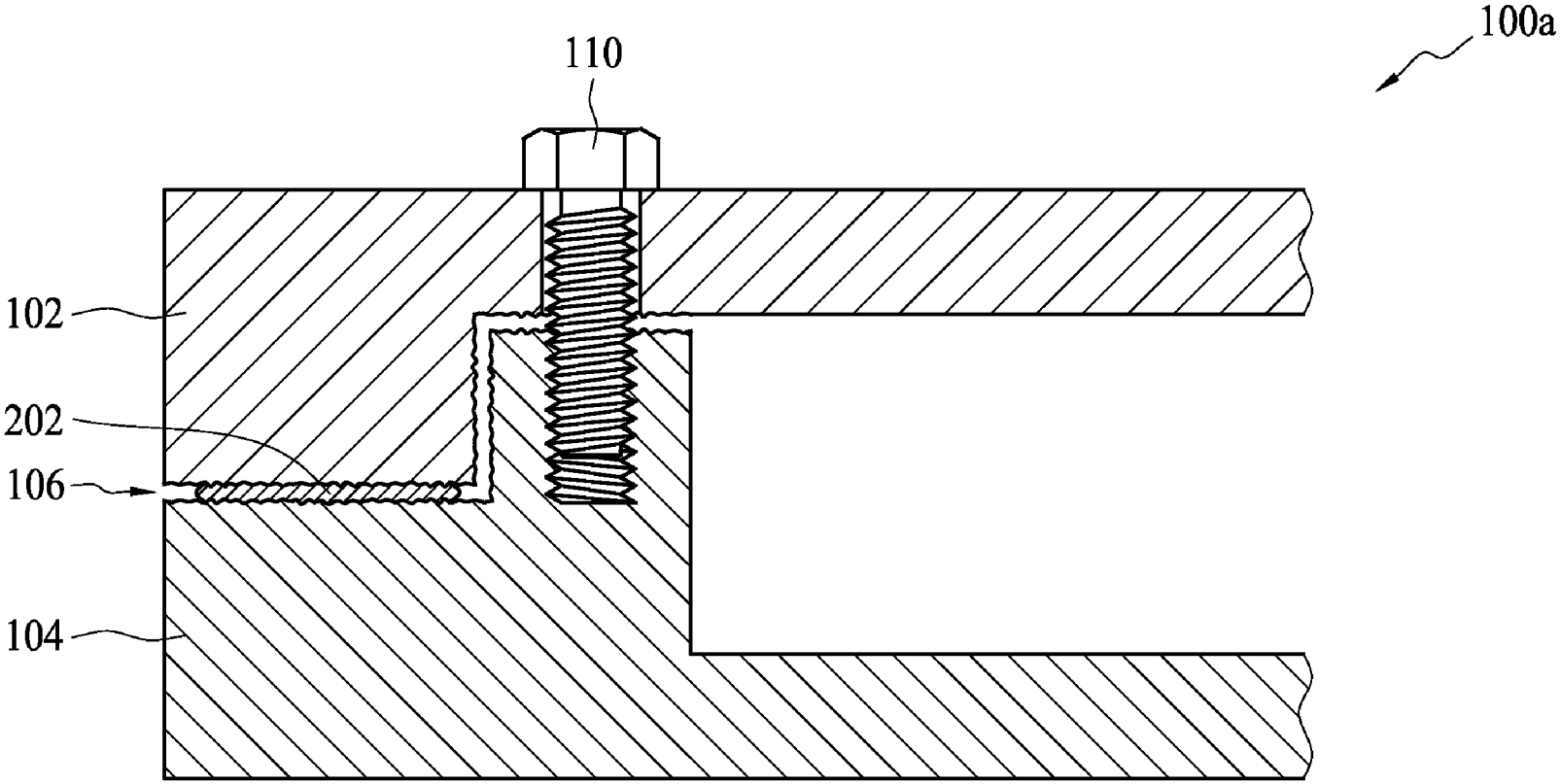
FIG. 2 (Prior Art)
FIG. 2 shows another prior art waterproof structure for a communication device.
Figure 3:
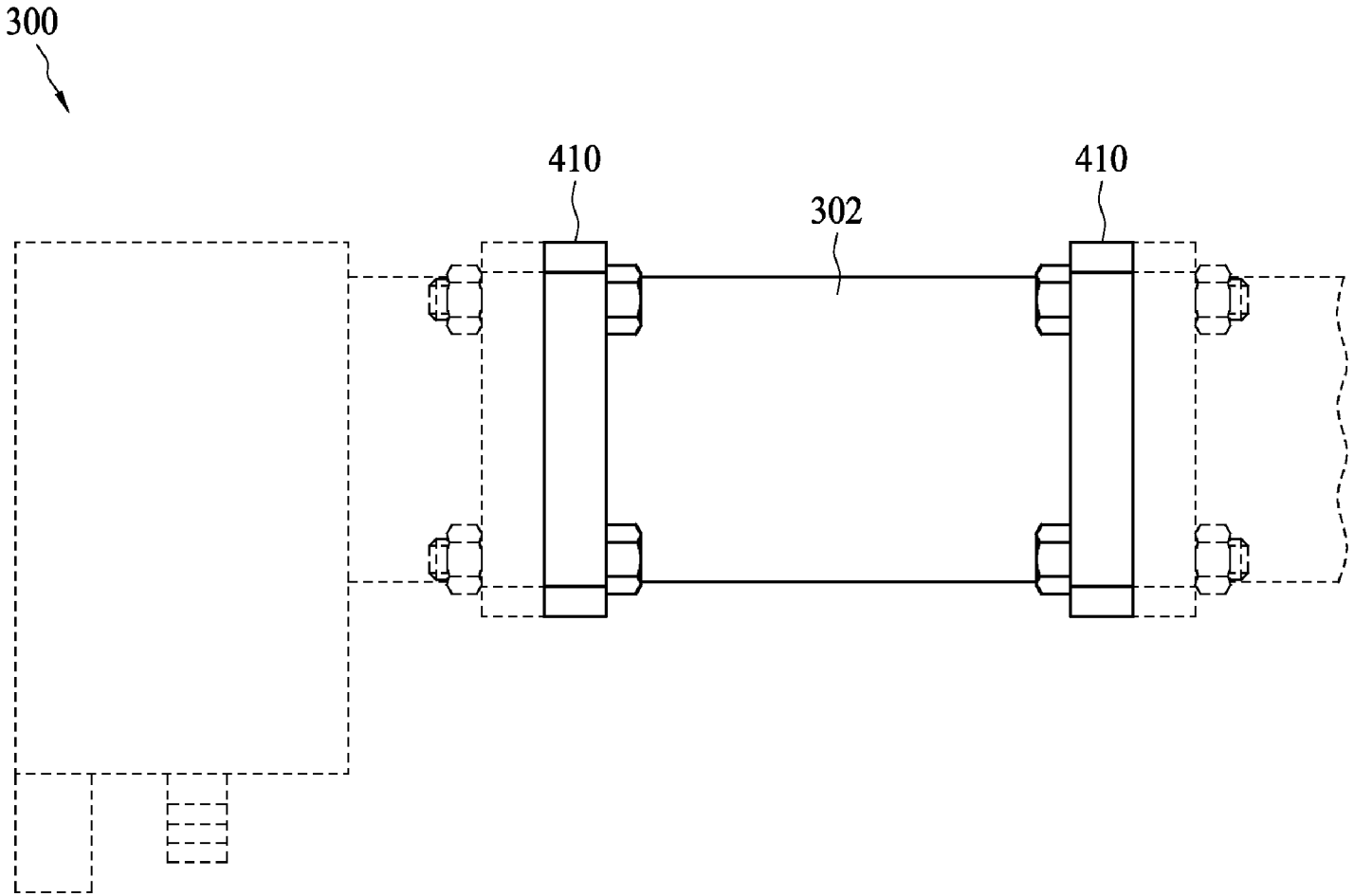
FIG. 3 shows a waterproof communication apparatus according to one embodiment of the present invention.

FIG. 3 shows a waterproof communication apparatus 300 according to one embodiment of the present invention. As shown in FIG. 3, the communication apparatus 300 comprises a waterproof communication device 302 configured to transmit an electromagnetic wave. In the present embodiment, the waterproof communication device 302 comprises a wave-guide device including a wave-guide structure (not shown).

Figure 4:
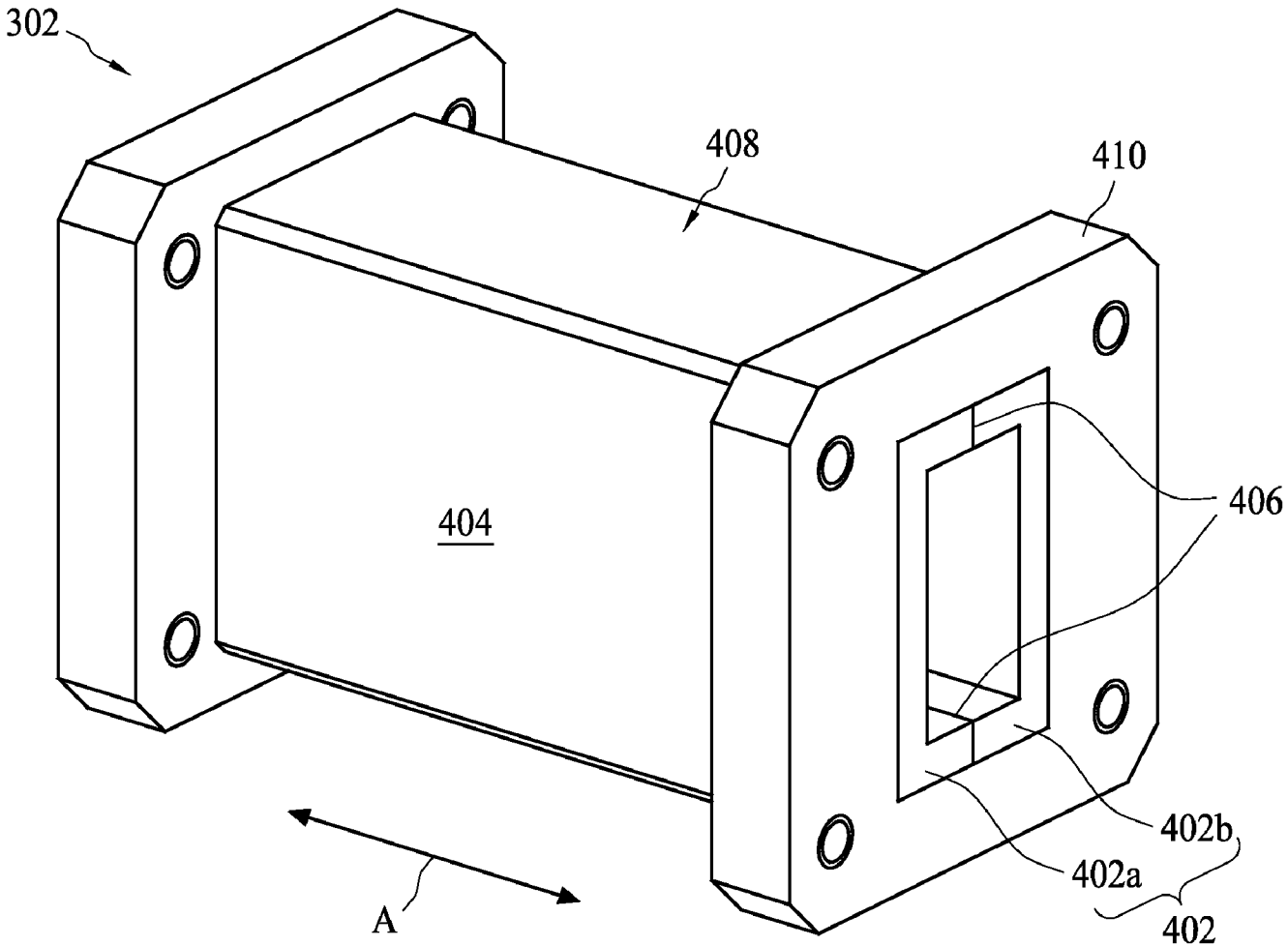
FIG. 4 shows a waterproof communication device according to one embodiment of the present invention.

FIG. 4 shows a waterproof communication device 302 according to one embodiment of the present invention. As shown in FIG. 4, the waterproof communication device 302 comprises a core assembly 402 and an enclosure 404 enclosing the core assembly 402. The enclosure 404 has a longitudinal (the direction shown by arrow A in FIG. 4) length substantially equal to the longitudinal length of the core assembly 402 and tightly and completely encloses the core assembly 402. Both the enclosure 404 and the core assembly 402 can be made of metallic materials, and the connection between the enclosure 404 and the core assembly 402 is a metallurgical bond if both are made of metallic materials. The enclosure 404 can also be made of plastics, and the enclosure 404 can be injection molded around the outer surface of the core assembly 402. In an exemplary embodiment, the method for enclosing the core assembly 402 initially provides a core assembly 402 in a mold cavity. Then molten metal is forced under pressure into the mold cavity, and thereby forms a die cast enclosure 404 around the core assembly 402.

Referring to FIG. 4, the core assembly 402 comprises a first portion 402*a* and a second portion 402*b*. A peripheral seam 406 is formed at the junction of the first portion 402*a* and the second portion 402*b* after the core assembly 402 is assembled. Because the seam 406 is enclosed within the enclosure 404 wrapping around the core assembly 402 and the enclosure 404 has a seamless outer peripheral surface 408, atmospheric moisture is totally blocked from penetrating into the seam 406, thereby achieving waterproofing capability.

Referring to FIG. 3 and FIG. 4, the enclosure 404 can comprise a pair of flanges 410, which are used to connect to other adjacent connecting devices of the communication apparatus 300 (FIG. 3).

Figure 5:
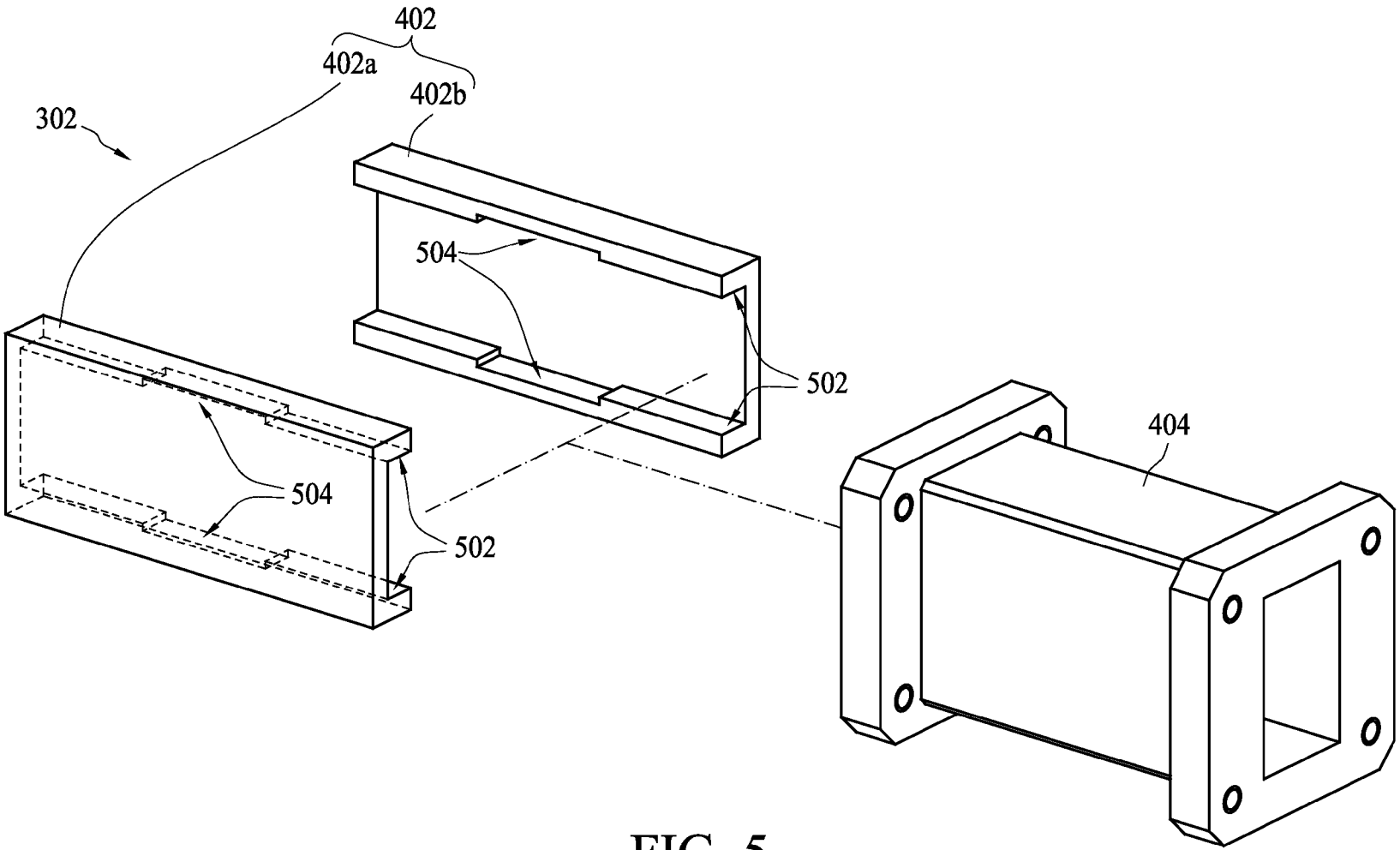
FIG. 5 shows an explosive diagram of a waterproof communication device according to one embodiment of the present invention.

FIG. 5 shows an explosive diagram of a waterproof communication device 302 according to one embodiment of the present invention. Referring to FIG. 4 and FIG. 5, the inner peripheral surface 502 (FIG. 5) of the first portion 402*a* and the second portion 402*b* includes a structure 504 (FIG. 5) varied in height. In the present embodiment, the structure 504 is downwardly concave in configuration. If an inner surface of a communication device 302, which is planned to be manufactured utilizing molding processes, includes such a structure 504, the communication device 302 shall be divided into and manufactured from several portions due to the mold-releasing difficulty of one-piece molded configuration with irregular inner surfaces. Finally, the communication device 302 is manufactured by assembling the manufactured portions. However, dividing the communication device 302 into several portions can allow for convenient manufacture of the communication device 302, the inner peripheral surfaces of which include a structure 504 varied in height, utilizing molding processes. However, seams are formed on the outer surface of the communication device 302, and atmospheric moisture may penetrate through the seams into the communication device 302. In contrast to the above limitations, the present invention provides an enclosure 404 with a seamless outer peripheral surface (408) (FIG. 4) enclosing the core assembly 402 assembled from the first portion 402*a* and the second portion 402*b*, between which a seam 406 (FIG. 4) is formed, and thereby achieves completely waterproofing capability. Furthermore, the core assembly 402 may be divided into and manufactured from a plurality of portions in accordance with manufacturing requirements such as the mold-releasing difficulty of one-piece molded configuration with irregular inner surfaces. Atmospheric moisture is not allowed to penetrate into the inside of the communication device 302 through the seams among the portions, because the seams are entirely enclosed within the enclosure 404.

Figure 6:
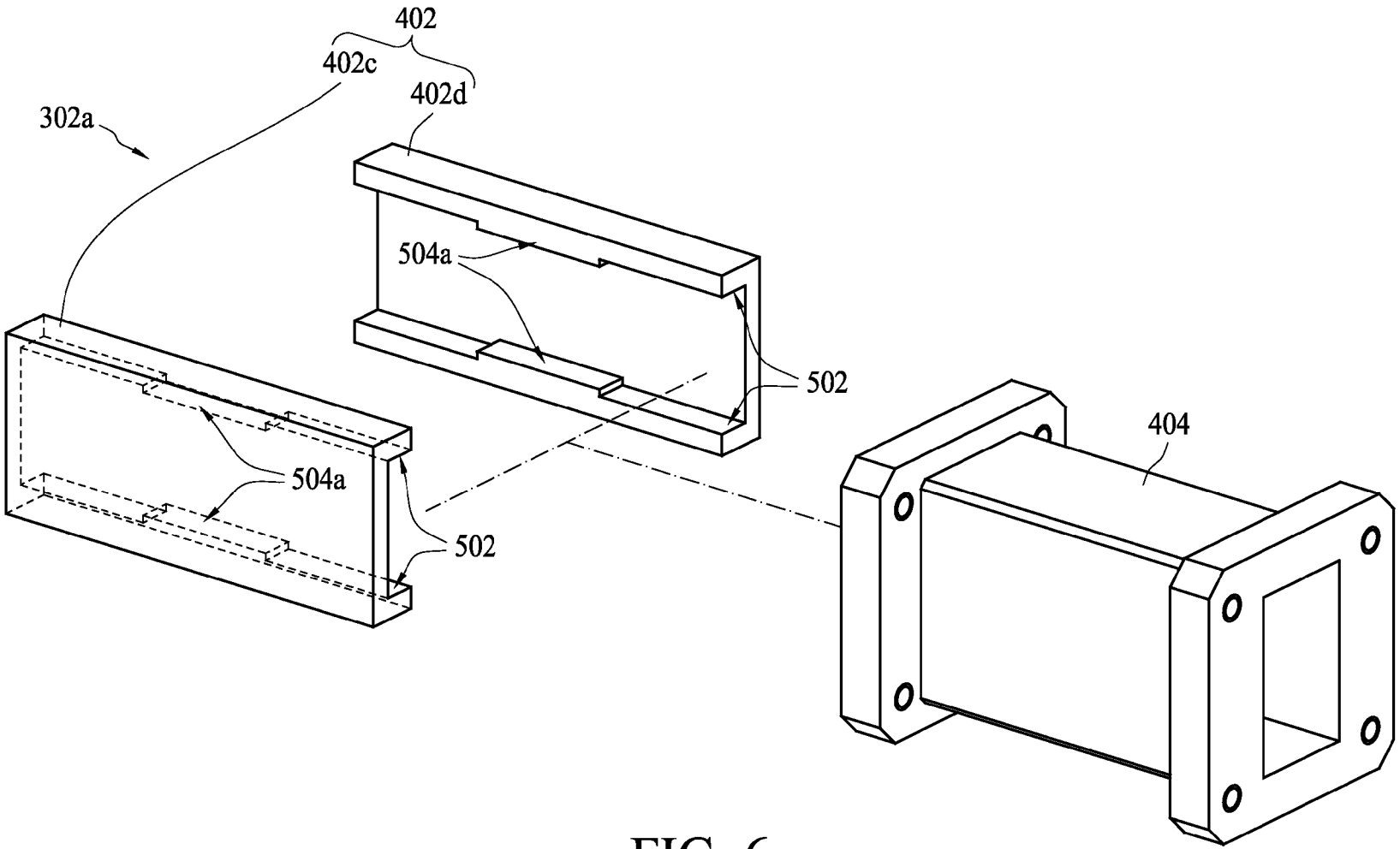
FIG. 6 shows an explosive diagram of a waterproof communication device according to another embodiment of the present invention.

FIG. 6 shows an explosive diagram of a waterproof communication device 302a according to another embodiment of the present invention. In the present embodiment, the waterproof communication device 302*a* comprises a core assembly 402 and an enclosure 404 enclosing the core assembly 402. The core assembly 402 comprises a first portion 402*c* and a second Portion 402*d*. The inner peripheral surface 502 of the first portion 402*c* and the second portion 402*d* includes a structure 504*a* varied in height. In the present embodiment, the structure 504a is upwardly convex in configuration.

In one embodiment, the structure (504 and 504*a*) varied in height can be a wave-guide structure, and the core assembly 402 can be a wave-guide device.

The above-described embodiments of the present invention are intended to be illustrative only. Numerous alternative embodiments may be devised by persons skilled in the art without departing from the scope of the following claims.

What is claimed is:

1. A waterproof communication apparatus, comprising:

a core assembly having at least one seam, configured to transmit an electromagnetic wave; and an enclosure enclosing the core assembly, configured to prevent the penetration of atmospheric moisture through the at least one seam into the inside of the core assembly, wherein the core assembly and the enclosure are comprised of metallic materials, and a metallurgical bond is provided between the core assembly and the enclosure.

2. The apparatus of claim 1, wherein the enclosure has a seamless outer peripheral surface.

3. A waterproof communication apparatus, comprising:

a wave-guide device having at least one seam; and an enclosure enclosing the wave-guide device, provided by a casting process, configured to prevent the penetration of atmospheric moisture through the at least one seam into the inside of the wave-guide device, wherein the wave-guide device and the enclosure are comprised of metallic materials, and the enclosure is provided by a casting process.

4. The apparatus of claim 3, wherein the enclosure has a seamless outer peripheral surface.

5. The apparatus of claim 3, wherein the enclosure further comprises a flange.

6. A waterproof communication apparatus, comprising:

a core assembly having at least one seam, wherein an inner peripheral surface of the core assembly includes a wave-guide structure varied in height; and an enclosure enclosing the core assembly, configured to prevent atmospheric moisture from reaching the wave-guide structure through the at least one seam, wherein the core assembly and the enclosure are comprised of metallic materials, and the enclosure is provided by a casting process.

7. The apparatus of claim 6, wherein the enclosure has a seamless outer peripheral surface.

8. The apparatus of claim 6, wherein the enclosure further comprises a flange.

* * * * *